United States Patent [19]

Dodds

[11] Patent Number: 4,501,076

[45] Date of Patent: Feb. 26, 1985

[54] SHOE CONSTRUCTION

[75] Inventor: Stephen G. Dodds, Farmington, Me.

[73] Assignee: Chesebrough-Pond's Inc., Greenwich, Conn.

[21] Appl. No.: 436,394

[22] Filed: Oct. 25, 1982

[51] Int. Cl.[3] ..... A43B 3/14

[52] U.S. Cl. ..... 36/11; 36/28; 12/142 MC

[58] Field of Search ..... 36/11, 10, 9 R, 21, 36/28, 43, 30 R, 44; 12/142 MC

[56] References Cited

U.S. PATENT DOCUMENTS

| | | | |
|---|---|---|---|
| 1,751,990 | 3/1930 | Gilkerson | 36/17 R |
| 2,212,514 | 8/1940 | Engel | 36/11 X |
| 2,817,163 | 12/1957 | Clark | 36/17 R |
| 3,083,477 | 4/1963 | Diamant | 36/28 |
| 3,133,360 | 5/1964 | Taylor, Jr. | 36/21 X |
| 3,152,407 | 10/1964 | Richards | 36/19 |
| 3,172,217 | 3/1965 | Colman | 36/28 |
| 3,302,312 | 2/1967 | Hartley | 36/11 |
| 3,431,570 | 3/1969 | Murphy | 36/11 X |
| 4,224,747 | 9/1980 | Winfield | 36/11 |
| 4,246,707 | 1/1981 | Pedersen | 36/59 R X |

FOREIGN PATENT DOCUMENTS

| | | | |
|---|---|---|---|
| 1141113 | 3/1957 | France | 36/11 |

*Primary Examiner*—Werner H. Schroeder
*Assistant Examiner*—Tracy Graveline
*Attorney, Agent, or Firm*—Brumbaugh, Graves, Donohue & Raymond

[57] ABSTRACT

A true moc shoe has a vamp with unitary bottom and side portions, and a sole coextensive with the vamp bottom. The vamp is stitched directly to the sole, and a cushioning element is interposed therebetween. The cushioning element has a shape substantially coextensive with the sole, and the peripheral edges of the element are spaced from the stitches. The sole may be formed of flexible rubber.

5 Claims, 3 Drawing Figures

SHOE CONSTRUCTION

BACKGROUND OF THE INVENTION

There are several distinct methods presently employed for manufacturing shoes. Two known shoe constructions are the flat lasted cemented or "California process" shoe, and the goodyear welt shoe. In each, the shoe is constructed by first sewing an upper to an insole bottom piece, and then attaching the insole to the outsole.

In California process shoes, the insole is cut from a material which is capable of being glued. The shoe upper is attached to the outsole by gluing the insole piece directly to the outsole. In goodyear welt shoes, a welt is sewn or glued to the insole piece, and the outsole is in turn stitched to the welt.

A third and entirely different shoe construction is that of a hand sewn or true moc shoe. Unlike a California process or goodyear welt shoe, a true moc shoe does not contain an insole piece attached to a shoe upper. Instead, a vamp is cut out and shaped to form both the bottom and sides of the upper, and is sewn directly onto the sole using a littleway stitch. The present invention relates to a shoe of this latter construction, i.e., hand sewn shoes.

It is well known that a shoe can be made more comfortable to wear by providing a cushion insert. Often this is done by inserting a cushion pad into the finished shoe so as to be disposed between the insole piece (or the vamp bottom in true moc shoes) and the foot of the wearer. Such cushioned sole pads have several evident drawbacks. They are prone to dislodge when inserting or removing the foot from the shoe. The pad may tear or bend. Such cushion pads may also tend to slide around when worn.

California process shoes are known in which a cushioning pad is retained in the shoe in a different manner. A cushioning pad is sandwiched between two pieces of insole material. This self-contained cushion sandwich, with the two insole pieces, is sewn to the upper in place of the normal single insole piece. The added insole piece, which is disposed on the lower side of the cushioning pad, is then glued to the outsole in the normal manner.

SUMMARY OF THE INVENTION

The sandwich type of arrangment described above, used in connection with flat lasted cemented shoes, produces good cushioning in the shoe and also holds the cushioning pad securely in place. It would therefore be desirable to employ such a sandwich type of construction in true moc shoes.

Therefore, I attempted to construct a true moc shoe incorporating the principles of the California process cushioned shoe, i.e. a sandwich type arrangment of a cushion element. However, due to the processes involved in making true moc shoes, it was not possible to construct a satisfactory shoe incorporating this arrangement. The presence of the extra leather layer rendered it difficult if not impossible to stitch the sole, vamp, and extra layer together such that the shoe was formed properly. In addition, the shoe proved to have an unsatisfactory appearance since it was difficult to prevent the extra layer from sticking out on the sides.

However, I have discovered that by avoiding the known approach of providing a self-contained, sandwich support for a cushion pad, it is possible to construct a true moc type of shoe which provides excellent cushioning characteristics, and which is advantageously simple in construction and easy to manufacture.

More particularly, the present invention is a cushioned shoe construction for a true moc shoe in which a cushioning element is not disposed in a self-contained sandwich arrangement, but is formed as an integral part of the shoe itself. The shoe is easy to construct, using normal methods for forming hand sewn shoes and, once constructed, the cushioning element is held securely in place between the upper and the sole to provide durability as well as comfort.

In an illustrative embodiment, a shoe has an upper which includes a conventional vamp with unitary bottom and side portions, and a sole coextensive with the vamp bottom portion. As in the case of normal true moc shoe constructions, the sole is stitched directly to the vamp bottom, preferably using a littleway stitching machine. However, prior to sewing the vamp to the sole, a cushioning element, which is generally coextensive with the sole, is positioned between the sole and the vamp. The vamp is sewn down onto the sole, and the cushioned element is tightly retained by the stitching between the vamp and the sole. The littleway stitching has the effect of binding down the edges of the foam to lock the element in place. Preferably, the element is formed of foam and does not extend into the stitching, such that the foam is compressed toward the center portion of the shoe to enhance the cushioning effect.

A shoe in accordance with the present invention may be formed with the customary leather sole, but in view of the inventive structure the sole may also be formed of flexible rubber. In the latter case, the sole is preferably a thermoplastic rubber possessing no-tear stitch properties, i.e. it can withstand the binding force of the littleway stitches.

For a better understanding of the invention, reference is made to the following detailed description of a preferred embodiment, taken in conjunction with the drawings accompanying the application.

DETAILED DESCRIPTION OF THE PREFERRED EMBODIMENTS

The invention represents a simple, easy to manufacture cushioned shoe of true moc construction. A shoe in accordance with the invention includes an upper 10 and a sole 12 having an upper contacting surface **12*a* and a contact walking surface 12*b***, attached thereto.

Figure 2:
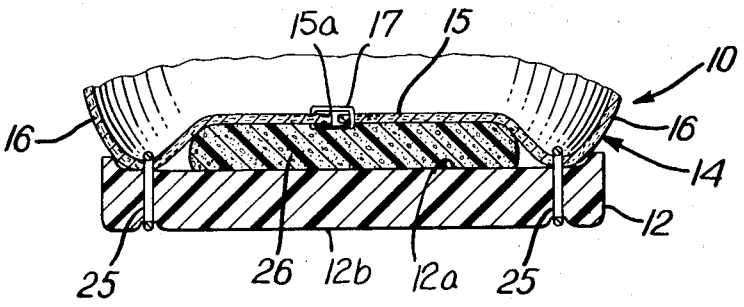
FIG. 2 is a sectional view taken through lines 2—2 of FIG. 1.
Figure 3:
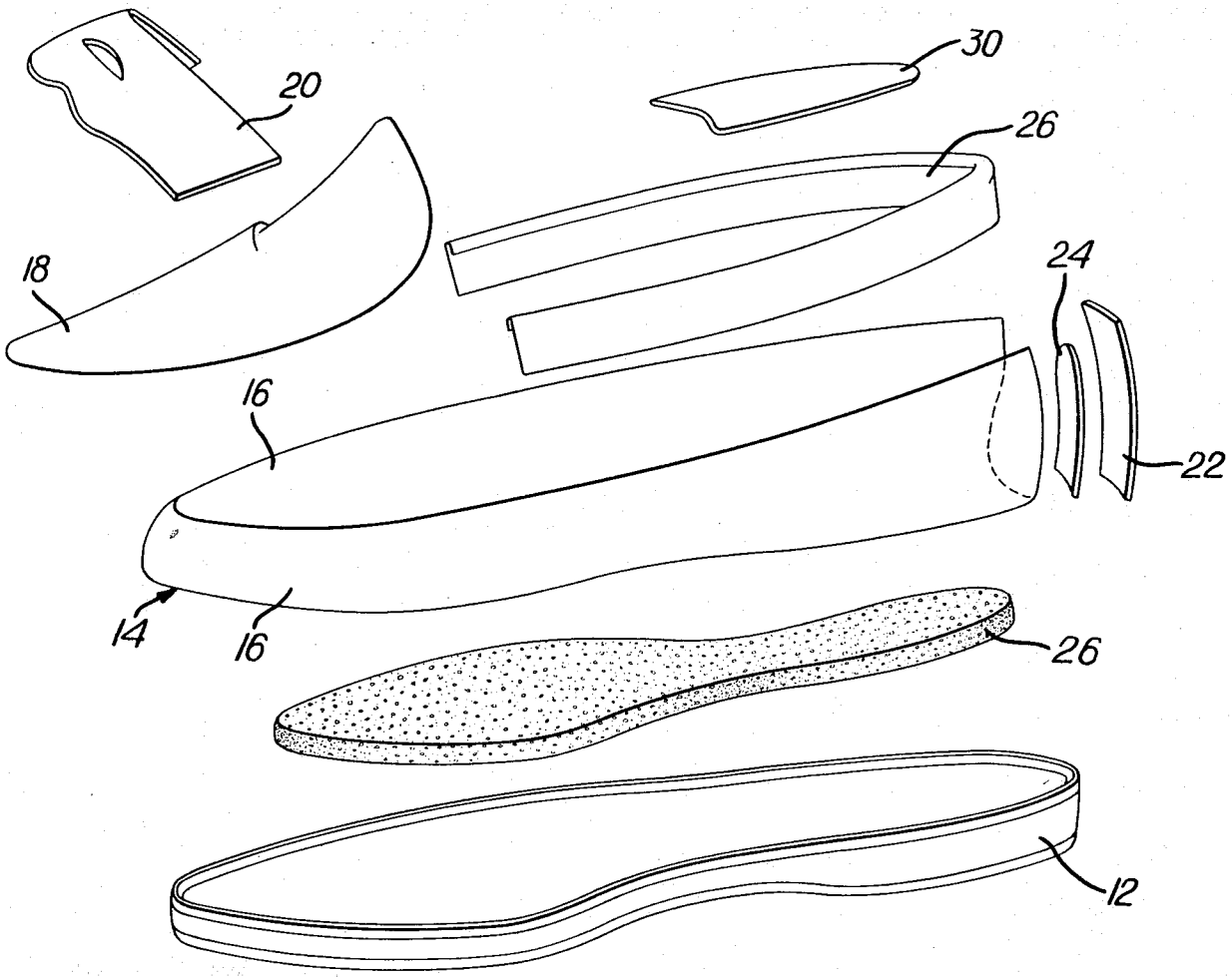
FIG. 3 is a pictorial exploded view of the components of a shoe in accordance with FIG. 1.

The upper 10 includes a vamp 14 having unitary bottom 15 and side 16 portions. Referring to FIGS. 2 and 3, the vamp 14 is shaped in the customary manner from a single piece of leather by cutting out a central portion in the forward part of the vamp; and thereafter pulling the vamp together along edges **15*a*. The edges 15*a* are held together by stitches 17** or by other suitable means.

The shoe upper 10 may take a variety of forms as are well known in the art. In the illustrated example of a penny loafer, a plug 18, with an ornamental overlay 20, is sewn onto the forward portion of the vamp sidewalls 16, to define the foot-receiving space. The rear portion of the shoe includes a leather back piece 22, which is sewn on to the rear portion of the vamp 14 in a known manner. Preferably, a counter 24 is sewn into the shoe for support. Finally, a collar 26 is sewn over the upper edge of the vamp sidewalls 16 for enhancing strength and wear.

In the illustrated embodiment, the sole 12 is formed of flexible rubber, and shaped so as to be thicker at the heel portion thereof. The sole 12 is stitched to the bottom portion 15 of the vamp 14 for securing the same together. The stitches 25 extend continuously around the periphery of the sole 12 and vamp bottom 15. A conventional littleway stitching process, in which approximately five side-by-side stitches per inch are applied to the shoe, may advantageously be employed.

Figure 1:
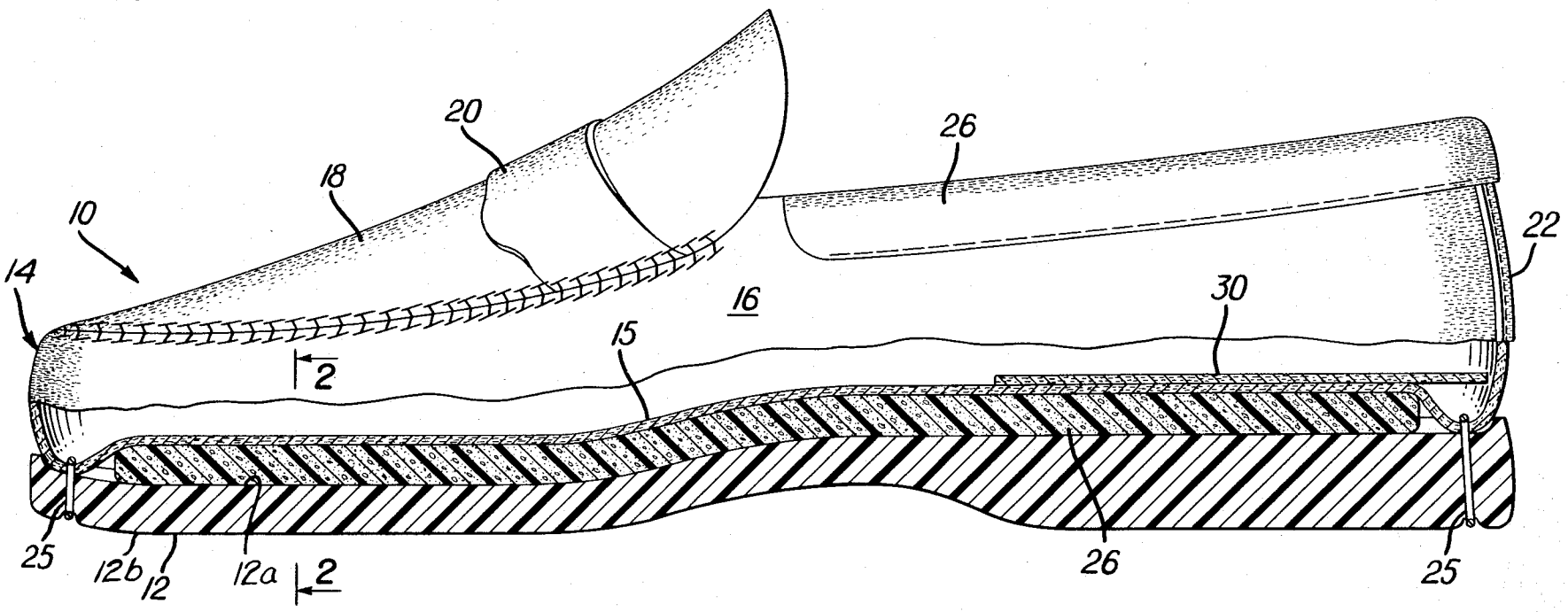
FIG. 1 is a side view, partially in section, of a shoe construction in accordance with the invention.

As shown, a flexible cushioning element 26, preferably made of sponge foam, is disposed between the vamp bottom 15 and the sole 12. As shown in FIG. 3, the foam element 26 is shaped in conformity with the sole, and as shown in FIGS. 1 and 2 is sized to be close to, but spaced from, the littleway stitches 25.

The foam element 26 is bound tightly between the facing surfaces of the vamp bottom 15 and the sole 12, and the edges of the foam element 26 are pressed down by the force of the littleway stitches 25 on the vamp bottom 15. Preferably, the foam is approximately $\frac{3}{8}''$ thick, and is spaced from the stitches by about $\frac{1}{2}$ inch about its periphery. When the shoe is stitched, the foam element is held securely at its edges by the vamp and sole, and may be pressed slightly toward the middle, causing the vamp bottom 15 to bow up. Depending upon the compressability of the foam, the inside shoe bottom may assume a shape as shown in FIG. 2, or with softer foams, may be pressed more toward its middle, such that the inside shoe bottom surface has, in cross-section, a more arcuate shape between the stitches 25 than that shown in FIG. 2.

In manufacturing a shoe in accordance with the invention, preferably the foam is glued to the bottom of the vamp prior to stitching the vamp 14 to the sole 12, so that the adhesive holds the foam in position during the manufacturing of the shoe. Once the shoe is assembled, a heel pad 30, and optionally and additional bottom liner may be inserted into the shoe, as desired. However, in view of the fact that in true moc shoes the vamp bottom 15 is formed of leather, it is not necessary to provide any such lining.

As constructed, the foam element 26 is held securely in place, and provides enhanced wearing comfort of the shoe. At the same time, it is protected from wear and protected from being damaged while inserting or removing the foot.

The foregoing represents a description of a preferred embodiment of the invention. Variations and modifications of the structure shown will be apparent to persons skilled in the art, without departing from the inventive concepts disclosed herein. All such modifications and variations are within the scope of the invention as defined in the following claims.

I claim:

1. A true moc shoe comprising an upper having a vamp with unitary bottom and side portions, a sole coextensive with said vamp bottom portion, said sole having an upper contacting surface and a contact walking surface, a plurality of stitches extending around a peripheral portion of said sole and stitching said sole directly to said vamp bottom portion, and a layer of cushioning material abutting said vamp and the upper contacting surface of said sole, wherein said cushioning layer is sized to be substantially coextensive with said sole and has edges spaced from said stitches, and wherein said stitches apply a force on portions adjacent said cushioning layer edges for tightly securing said layer in place between said vamp and sole.

2. A shoe as defined in claim 1, wherein said sole is formed of flexible rubber.

3. A shoe as defined in claim 1, wherein said layer has a thickness of approximately $\frac{3}{8}''$ and wherein said edges are spaced from said stitches a distance of approximately $\frac{1}{2}''$.

4. A method of forming a cushioned shoe with a sole having an upper contacting surface and a contact walking surface, comprising the steps of: positioning together a vamp, with unitary bottom and side portions, and at least the portion of said sole containing said upper contacting surface, wherein said sole is coextensive with said vamp bottom; positioning a layer of cushioning material to abut said vamp and the upper contacting surface of said sole, and stitching said vamp bottom directly to at least the portion of said sole containing said upper contacting surface, about a peripheral portion of said sole, with said layer of cushioning material therebetween, wherein said cushioning material is shaped to have edge portions spaced inwardly from said stitches.

5. A method defined in claim 4, wherein said cushioning material is pre-positioned on and adhered to said vamp bottom prior to positioning said vamp and sole for stitching.

* * * * *